US005421803A

United States Patent [19]

Kemanjian

[11] Patent Number: 5,421,803

[45] Date of Patent: Jun. 6, 1995

[54] METHOD OF FABRICATING PACKS OF SELF OPENING PLASTIC BAGS

[76] Inventor: Gary Kemanjian, 1305 Daveric Dr., Pasadena, Calif. 91107

[21] Appl. No.: 237,601

[22] Filed: May 2, 1994

Related U.S. Application Data

[62] Division of Ser. No. 110,814, Aug. 23, 1993, Pat. No. 5,307,935.

[51] Int. Cl.[6] ..... B31B 3/62; B31B 27/62; B31B 3/98

[52] U.S. Cl. ..... 493/198; 493/204; 493/238; 493/264

[58] Field of Search ..... 493/193, 194, 195, 196, 493/198, 238, 264

[56] References Cited

U.S. PATENT DOCUMENTS

| | | | |
|---|---|---|---|
| 4,545,781 | 10/1985 | Carl et al. | 493/220 |
| 4,807,754 | 2/1989 | Rowe | 493/926 |
| 4,923,436 | 5/1990 | Gelbard | 493/194 |
| 4,925,438 | 5/1990 | Wagner | 493/194 |
| 4,995,860 | 2/1991 | Wilfong | 493/195 |
| 5,078,067 | 1/1992 | Williams | 493/195 |
| 5,087,234 | 2/1992 | Praper et al. | 493/926 |
| 5,125,585 | 6/1992 | Wooley et al. | 493/264 |
| 5,226,858 | 7/1993 | Snowdon | 493/204 |

*Primary Examiner*—William E. Terrell
*Attorney, Agent, or Firm*—Beehler & Pavitt

[57] ABSTRACT

Packs of T-shirt type plastic shopping bags are fabricated in such a manner that when the bags are mounted on conventional racks, as each bag is pulled off the rack, the front wall of the next ensuing bag is pulled out to open the bag for the depositing of articles to be packed in the bag. This is accomplished by providing a special configuration for the central tab which is hooked on the upwardly extending element in the rack. The tab has a narrow neck which is partially slit between the neck edges and is adhered to the tabs of adjacent bags by an adhesive spot applied in hot melt condition below the slit. Thus, pulling of the rear wall of each bag first effects a rupture of the tab neck of the rear wall of the bag at the tab slit, while simultaneously rupturing the neck of the tab of the front wall of the next ensuing bag and pulling said front wall away from the rear wall of the latter bag, until, with further pulling, the adhered spots on the neck of the rear wall of the bag being pulled and on the neck of the front wall of the next ensuing bag, detach from each other. Such adherence is accomplished in the course of production of bag packs by a gun discharging a hot melt adhesive.

1 Claim, 4 Drawing Sheets

METHOD OF FABRICATING PACKS OF SELF OPENING PLASTIC BAGS

This is a divisional of application Ser. No. 08/110,814, filed Aug. 23, 1993, now Pat. No. 5,307,935.

FIELD OF THE INVENTION

This invention relates generally to the field of plastic bag fabrication and particularly, to the fabrication of plastic grocery or shopping bags in packs for mounting on racks disposed conveniently in the vicinity of the stations of grocery or other store clerks, from which racks the bags are removed for packing customers' purchases.

BACKGROUND OF THE INVENTION

In recent years, the expansion of the use of plastic packing or shopping bags, particularly in grocery stores, has been nothing less than phenomenal. One customer in one line in a supermarket having a dozen or more lines may easily have his or her grocery purchases packed in anywhere from four to ten bags. In certain arrangements where the packs of bags are mounted on racks, such as are shown in U.S. Pat. Nos. 4,811,417 an RE 33,264, as well as in other types of mountings, a problem which tends to impede the efficiency of the actual packing process is that it requires some special digital effort to open the bags as they are pulled off the rack. This is because when packs of the bags are formed, they are pressed to minimize the space which they occupy, and this compression not only places adjacent bags tightly against each other, but it also places tightly against each other the plastic sheets constituting the side walls of each individual bag. As each bag is removed, therefore, some fingering effort is required to open the upper edges of each bag to produce the bag cavity into which the customers' purchases are to be packed. Such fingering of the bags to open their upper edges not only slows the packing process, but also, after a prolonged period of bag packing, tends to result in cramping of the packer's fingers. In addition, if, as is often the case, the packer must wet his or her fingers with saliva in order to separate the bag walls to open the bag, this can result in the undesirable transmission of bacteria or viruses to the customers' articles.

In order not only to minimize the presently required digital action of packers to open each bag pulled from a rack of the type illustrated in the patents mentioned above, but also to improve bag packing efficiency, it has been proposed to attach in some manner the rear side wall of a leading bag to the front side wall of the ensuing adjacent bag so that, as the leading bag is pulled from a rack, the front side wall of the ensuing bag is pulled apart from its rear side wall. Thereby, after detachment and removal of the leading bag, the packer is presented with the ensuing bag with its side walls pulled apart, so that groceries or other items may simply be deposited into the thus created bag cavity.

However, although efforts have been undertaken to devise some method and means for securing some portion of the rear side wall of a leading bag to some portion of the front side wall of the next ensuing bag, by applying an adhesive at one or more selected points between such abutting walls, so as to cause each ensuing bag to be opened as its preceding bag is pulled off the rack, such prior art efforts have heretofore been unsuccessful. Consequently, bag packs to accomplish this purpose are not currently marketed. Among the reasons for this lack of success are (a) the adhesive joinders have been unreliable; (b) after the bags are separated, objectionable patches of adhesive remain on portions of the bag walls to cause undesired adherence to other articles, or to the hands and fingers of those persons who may pick up the bags for their subsequent intended uses; and (c) the adhesions effected have in some instances resulted in ripping of the bags.

SUMMARY OF THE INVENTION

The present invention effectively accomplishes the objective of providing bag packs of the types illustrated in the patents hereinabove referred to in which, as each bag is removed from the pack, it pulls open the next succeeding bag to present to the packer or clerk, packing customer articles, the open bag cavity into which preselected articles may immediately be deposited. In turn, when the bag has been filled and is pulled off the rack, it in turn pulls open the next ensuing bag, and so on.

This objective is accomplished according to the present invention by modifying the configuration of the hooking tab extending upward from the center of the lower cut-out edge of each of the two walls of the bag. This modification provides an upper expanded portion which is slotted to receive the centrally disposed upwardly extending element of the rack, and connects said expanded portion by a narrow neck to the upper edge of the sheet which defines the bottom of the cut out area. The neck is slit transversely between, but not extending to, its edges, and is provided with a spot of adhesive just below the slit on the outside of the neck of the tab extending upwardly from the rear wall of the bag to effect an adhesion at the same location on the outside of the neck of the front wall of the next ensuing bag. This arrangement produces sufficient adhesion to the front wall of the ensuing bag to cause it to be drawn sufficiently forwardly with the removal of its preceding bag to create an open space or cavity between its front and rear walls; but, because of the particular adhesive application, with a little more pulling force applied to the preceding bag as it is removed from the rack, the adhered tab of the rear wall of the preceding bag is readily detached from its adhesion to the adhesion to the front wall of the ensuing bag. Simultaneously, because of the slit above the adhesive application on the tab neck of the front wall of the ensuing bag, which slit, as stated above, extends between the neck edges but not quite to such edges, the small amount of pulling force which is required to effect detachment of the tab neck on the rear wall of the leading bag from the tab on the front wall of the ensuing bag, is also sufficient to rupture the tab neck of the front wall of the ensuing bag, thereby leaving the expanded portion of the tab on the central projecting element and opening the next ensuing bag. Upon detachment of the tab of the rear wall of the leading bag, the latter may be removed from the rods extending through the handles of the bags.

The adhesive utilized in the present invention is preferably a rubber-based, pressure-sensitive adhesive which is applied by heating it to a liquid condition and dispensing it through a reduced cavity gun at precisely timed intervals as each bag is being severed from a roll then to be stacked and pressed together with other bags on the stack, die cut to its final bag configuration. The entire bag forming, cutting, gluing and stacking operation is preferably computer controlled in order to obtain the most desirable speed and efficiency.

It will be found that packs of plastic bags formed and produced in accordance with the present invention, when mounted on standard type racks, are self-opening as each preceding bag is being removed from the rack, and, because of the nature of the adhesive and the manner in which it is applied to the small neck area of the tab, no undesirable tacky residue is left along the upper cut-out edge of the rear wall of one bag, or the front wall of the ensuing bag. The present invention, therefore, offers unlimited commercial possibilities.

DESCRIPTION OF THE DRAWINGS

In the accompanying drawings.

DESCRIPTION OF THE PREFERRED EMBODIMENT

Figure 3:
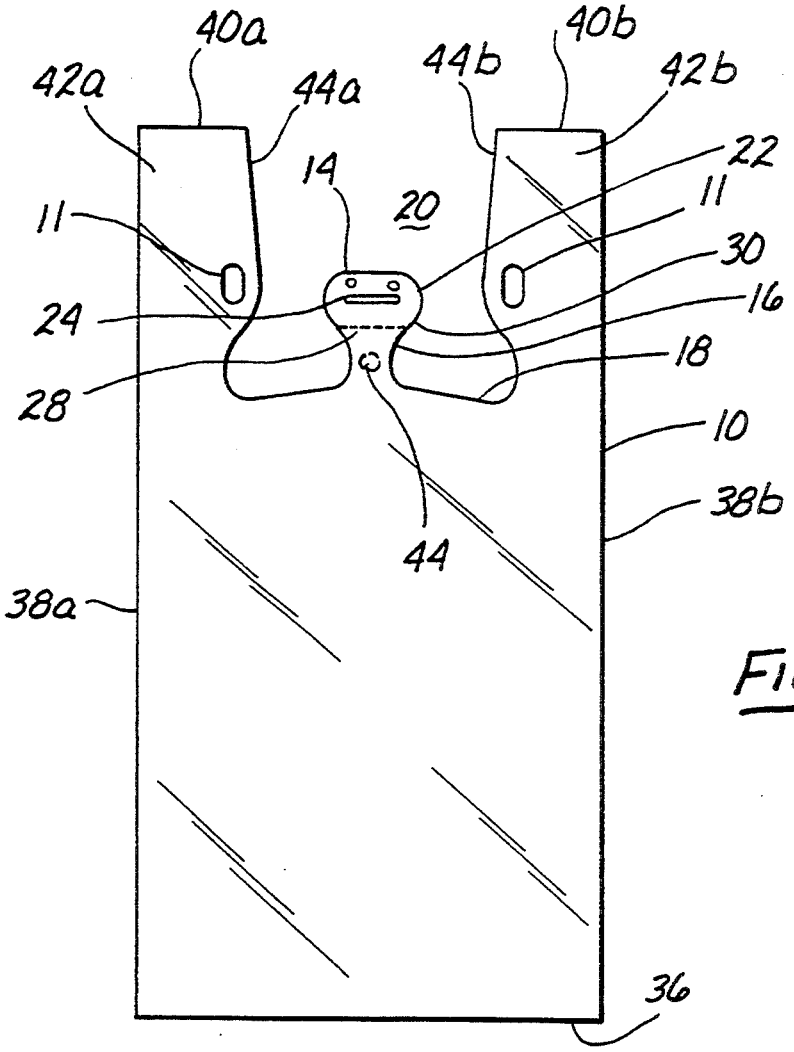
FIG. 3 is a plan view of a T-shirt type bag, packs of which are fabricated through the steps illustrated schematically in FIG. 1.

Referring first to FIG. 3 of the drawings, the bags 10 of the present invention are of the T-shirt type which are intended to be mounted on currently available racks 12 of the type which are shown in reissue Pat. Re. 33,264, issued Jul. 17, 1990. The central tab 15 of the bags shown in the latter patent, however, is modified in the present invention to the shape of the tab 14 shown in FIGS. 3 through 7. This tab 14 comprises a narrowed neck portion 16 which extends centrally upwardly from the lower edge 18 of the cutout area 20 and is capped by an upper expanded portion 22. The latter is slotted transversely at 24 to receive the upwardly projecting rack element 26. In addition, a transverse slit 28 is cut along the line approximately where the upper expanded portion 22 coalesces with the neck 16. The slit 28, however, does not extend quite to the side edges of the neck thereby to leave on each side of the slit 28 a connecting strip 30 (of approximately ⅛') between the neck 16 and the upper expanded portion 22 of the tab 14.

Figure 1:
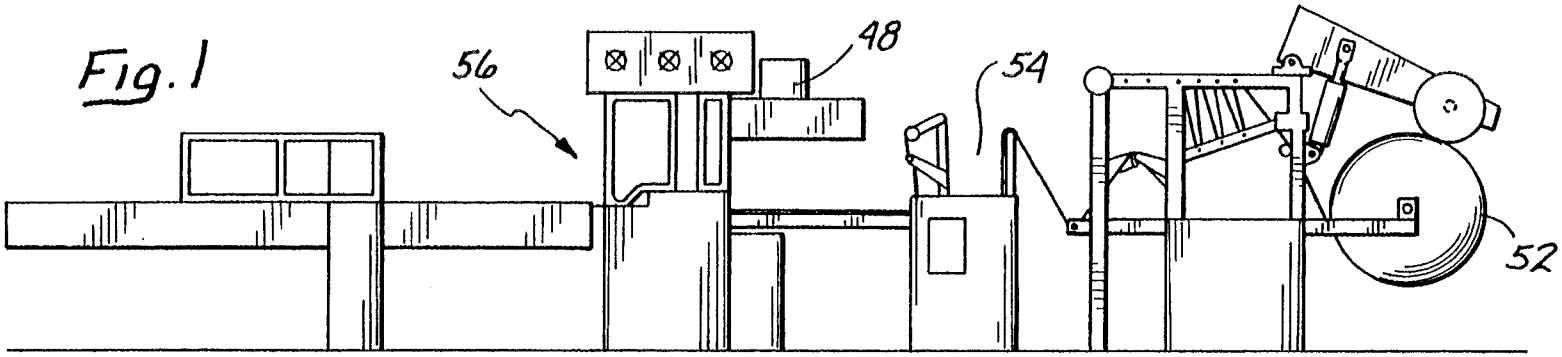
FIG. 1 is a schematic layout for a series of machines which may be employed to fabricate bag packs of the present invention.
Figure 2:
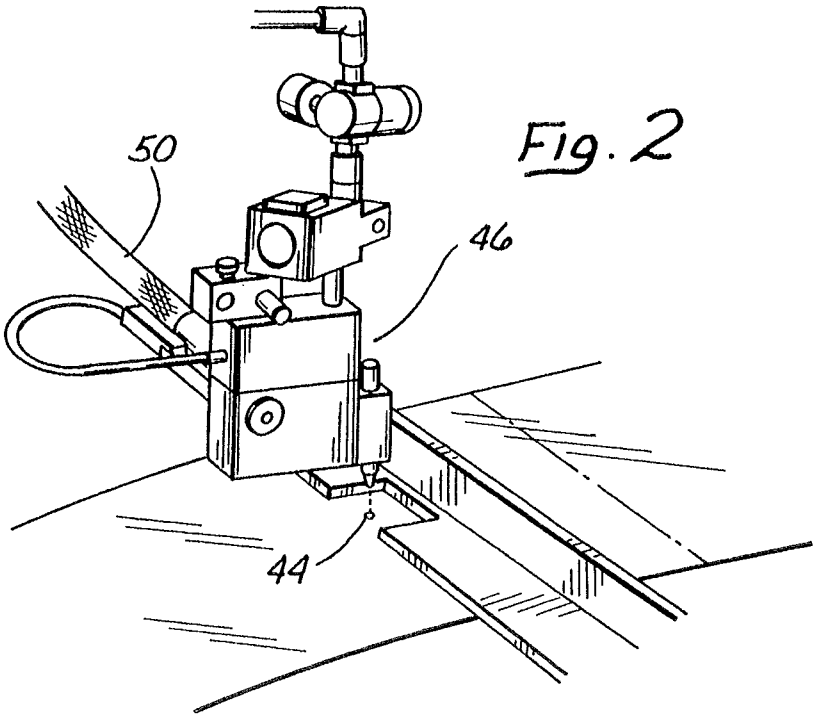
FIG. 2 is a perspective view of an adhesive gun applicator which is preferably utilized in one of the steps of fabrication illustrated in FIG. 1.
Figure 5A:
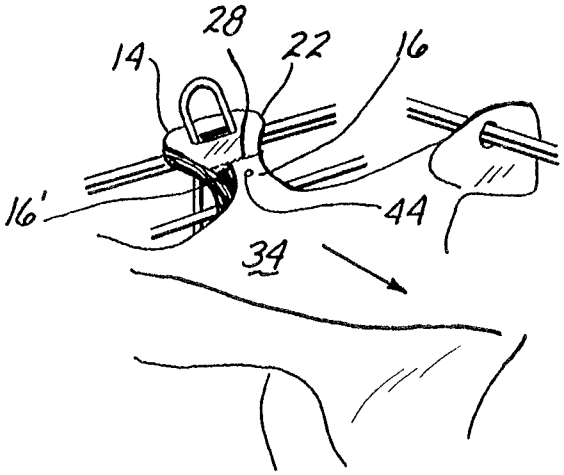
FIG. 5A is a partial view similar to FIG. 5 illustrating the rupture of the neck of the central tab upon further pulling of a bag in the manner shown in FIG. 5.
Figures 1A, 6:
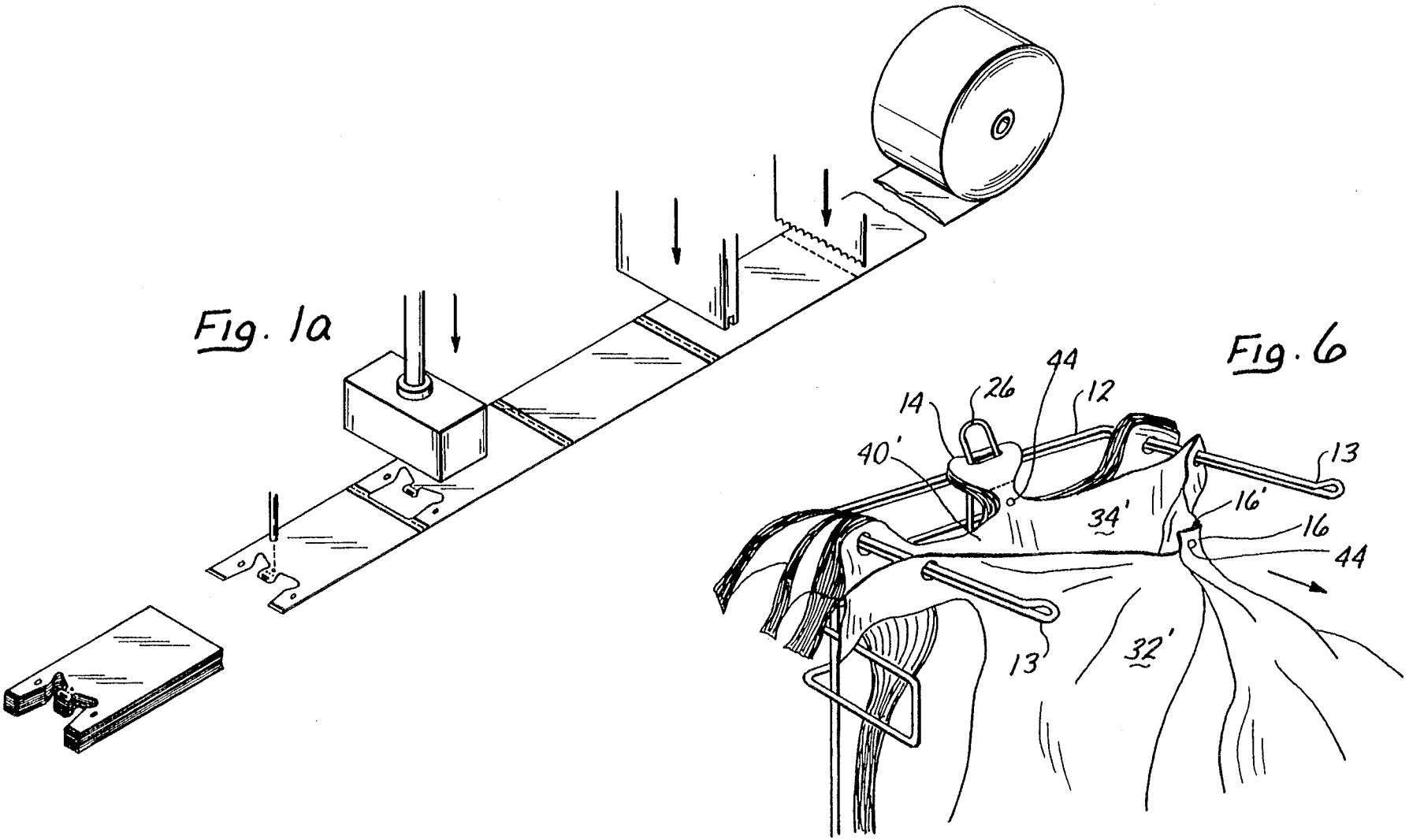
FIG. 1*a* illustrates the several steps of the method of producing bag packs.
FIG. 6 is a perspective view similar to FIG. 5, but showing the opening of the next ensuing bag after that which is being pulled in FIGS. 5 and 5A.
Figure 7:
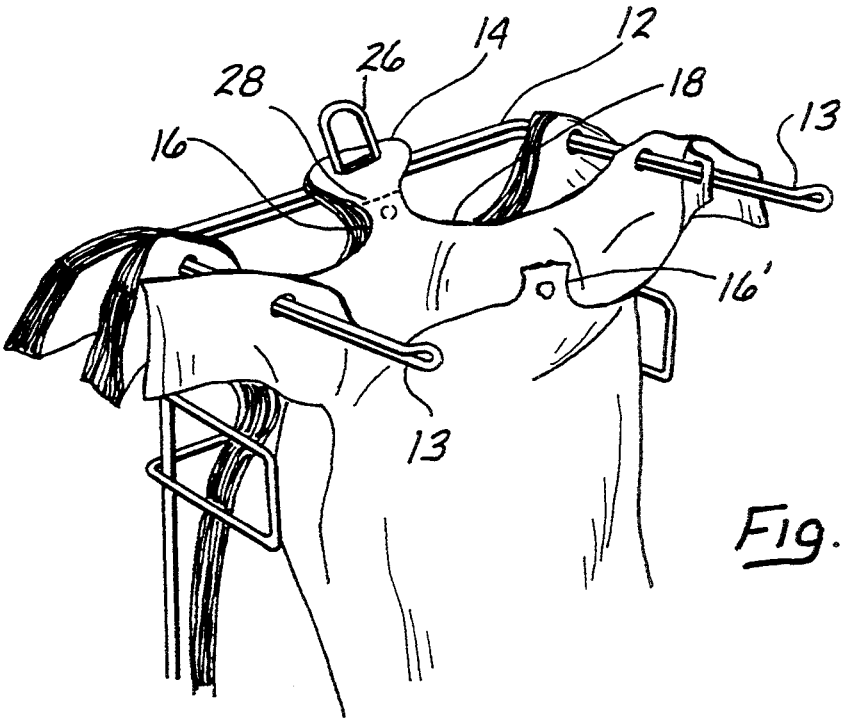
FIG. 7 is a view similar to FIGS. 5 and 6, but illustrating the ensuing bag shown in FIG. 6 after the tab neck of the preceding bag has been detached and the ensuing bag stands fully open.
Figure 5:
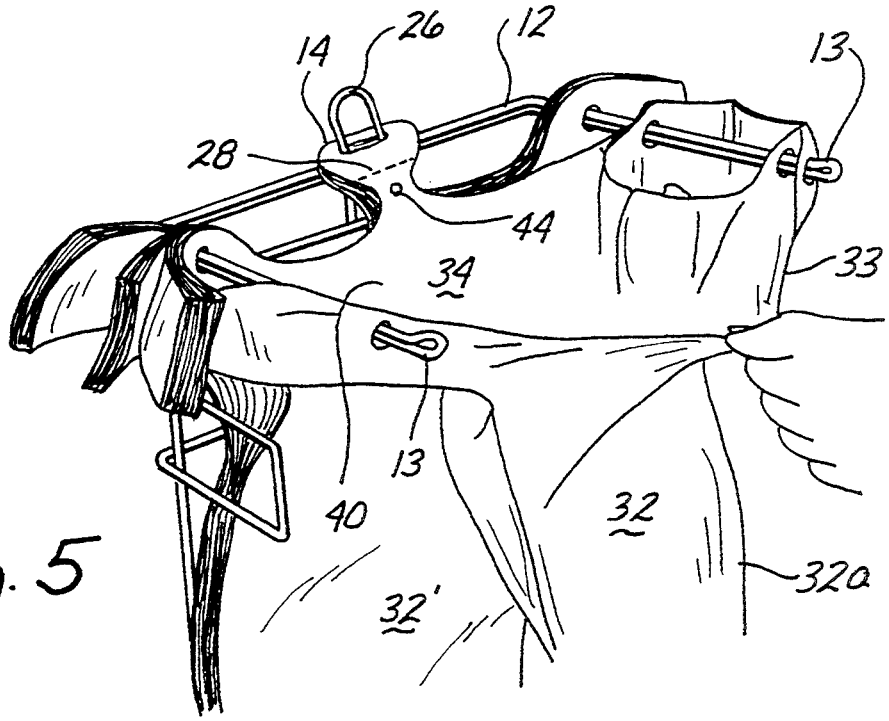
FIG. 5 is a view similar to FIG. 4, but showing the pulling open of the first bag of the pack.

It will be understood that each bag 10 otherwise may be configured similarly to prior art bags. Such bags are formed as best shown in FIGS. 5, 6, and 7 of a front plastic sheet 32 and a back or bottom sheet 34, both of which are similarly configured and secured together in register along their bottom edges 36, their side edges 38*a* and 38*b*, and the top edges of the straps 42*a* and 42*b*, respectively. The inner edges 44*a* and 44*b* of the straps 42*a* and 42*b*, respectively, and the bottom edges 18 and the tabs 14 of each sheet are unsealed, thereby to enable the two sheets 32 and 34 to be pulled apart from each other to form the bag cavity 40. When the bags are formed in packs according to the present invention, as hereinafter explained, just prior to each bag being deposited on top of another bag, a small spot of adhesive 44 is applied to the outer face 32*a* of the sheet 32 at its neck 16 so that when the tab neck 16 of the outer face (not shown) of the rear sheet 34 of the next bag is placed on top of the bag having the adhesive deposit 44 and pressed thereagainst, the neck 16 of the bottom face of the next bag will adhere to the neck 16 of the upper face 32 of the bag upon which the next bag is so placed and pressed downwardly in order to form the pack. In accordance with the present invention, the actual spot of adhesive 44 desirably is of a diameter of approximately 3/16ths of an inch, and the adhesive is deposited in hot melt form by a pressure gun 46, shown in FIG. 2, such as is made and sold by Nordson Corporation of Duluth, Ga. The hot melt adhesive, such as that sold by Heartland Adhesives and Coatings of Germantown, Wis. under its designation H403, desirably would be placed in and melted by an applicator 48, disposed as shown in FIG. 1, such applicator being of the type of the Series 31 or Series 34 applicators, also made by said Nordson Corporation. The melted adhesive may be conducted from the applicator 48 to the gun 46 by resistance temperature detector style hoses 50, also made and offered by said Nordson Corporation.

The actual fabrication of bag packs, except for the adhesive application described is otherwise conventional in that a roll of plastic tubing is unwound to be passed through a station 54, where the tubing is transversely perforated at regularly spaced intervals and thermoplastically sealed along the edges abutting each side of the transverse perforation. At the station 56, the adhesive 44 is applied at a spot on a upper face of the sheet which spot will later become the neck 16 of a bag. From there, the bags move to the next station 58, where they are pulled apart at their perforations and stacked, following which, after the stacking of a predetermined number of bags is completed, the bags are pressed together and the stack is die cut to the configuration for the bags shown in FIG. 3.

As previously mentioned, when the bags are thus stacked and pressed together, adherence occurs at the spot 44 on the neck 16 of each tab 14 between the bottom sheet of the top bag and the top sheet of the next ensuing bag. The bag packs thus formed are ready for packing and shipping and, ultimately, for mounting on a rack 12 in a supermarket or other establishment where the bags are utilized to pack customers' purchases. Desirably, the fabrication process, including particularly the application of adhesive spotting is computer controlled.

Figure 4:
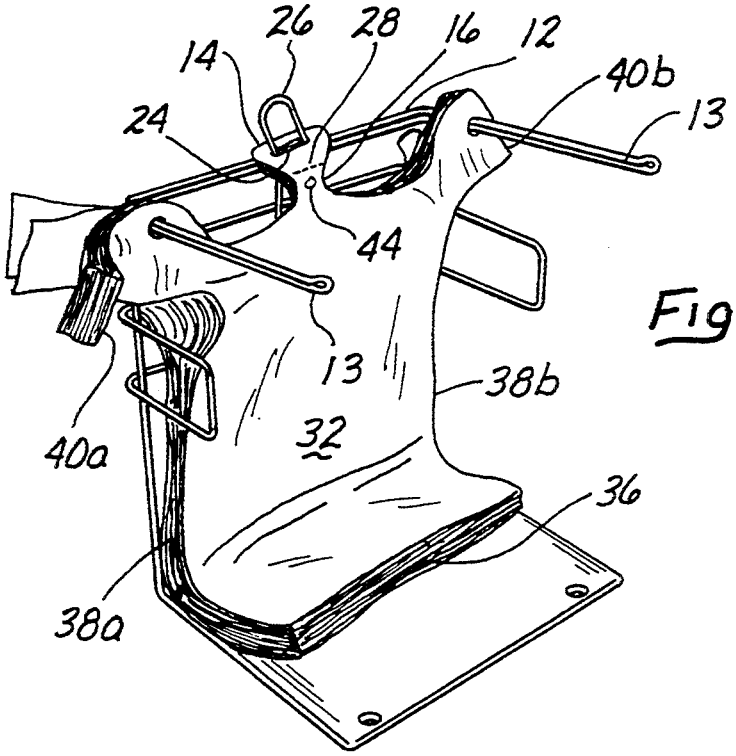
FIG. 4 is a perspective view of a pack of bags fabricated in accordance with the present invention and mounted on a conventional rack.

In use, then, a stack of bags 10 is mounted on a rack 12 by inserting the side rods 13 through the orifices 11 in the straps 42*a* and 42*b* of the several bags 10 comprising the stack. At the same time, the horseshoe-like element 26 of the rack is inserted through the slots 24 in the bag tabs 14. Thus mounted, the bags are ready for use by the store packer, as shown in FIG. 4.

When groceries or other articles are to be packed, as shown in FIG. 5, the packer grips the forward edge 33 of the front wall 32 of a bag 10 and pulls it open to establish a cavity 40 into which groceries or other articles may be placed. When the bag is packed, further pulling on the bag's front wall 32, as shown in FIG. 5, results in a tearing of the neck 16 of the bag from the expanded upper portion 22 of the tab 14 at the slit 28 in the rear wall 34 of the bag being pulled. Simultaneously, the neck 16' of the front wall of the next ensuing bag (not shown) is also detached from its tab 16 due to the adherence to the adjacent neck 16 at the adhesive spot 44. Further pulling, as illustrated in FIG. 6, results in the front wall 32' being pulled away from the rear wall 34' of the next ensuing bag to produce the cavity 40' in the next ensuing bag 10'. With little further pulling, the adhered necks 16 and 16' (FIG. 6) are separated to leave the neck 16' as shown in FIG. 7. Thus, with each pulling of a bag 10 and its removal from the rack 12 of the rods 13, the front wall 32' of the next ensuing bag is pulled away from the back wall 34' of that bag to produce the desired cavity 40' into which articles may be deposited by the store packer. At the same time, the preceding bag is detached from the ensuing bag at the small spot 44 of adhesive which has temporarily held together the abutting tab necks 16 and 16'. Because of both the small size of the adhesive spot 44 and the adhesive recommended for application to the bags as hereinabove explained, any adhesive left on the upper edge 18 of the bag will be found to be completely unobjectionable.

From a consideration of the foregoing and the accompanying drawings, it will be appreciated that the present invention provides an inexpensive and effective manner for providing what may be considered packs of self-opening bags, thereby decreasing the time and energy which a packer must employ in supermarket, grocery store, or other merchandising establishments.

I claim:

1. A method of producing a pack of coinciding pressed together T-shirt type plastic bags for dispensing from a rack when mounted thereon; said rack comprising a pair of parallel rods spaced from each other by a first predetermined distance, said rods being secured to project normally to a vertical plane and lying in a transverse horizontal plane; said rack further being provided with an element disposed equidistantly between said rods and projecting upwardly to a height below said horizontal plane, each of said bags being formed of a pair of abutting polyethylene front and rear sheets of a rectangular configuration, said sheets being sealed to each other along their sides and bottom edges and having a pair of handles spaced from each other by a distance in excess of said first predetermined distance and formed by a cut-out extending downwardly and inwardly of the side edges a second predetermined distance from the central portion of the upper edges of the sheet, said handles being sealed across their upper edges, the central area of the lower edge defining the cut-out of each sheet also defining an upwardly projecting tab, said tab comprising an upper expanded portion connected to the lower edge of the cut-out by a narrower neck portion; each of said handles being orificed at a predetermined point so that all of the orifices of the handles of the bags of the pack are in register, the predetermined points in the handles of each bag being spaced apart from each other by said first predetermined distance, the expanded portions of the tabs of each sheet having an inner transverse slot, and the neck portion of each tab being slit transversely between, but not extending to, the neck edges, the neck of the tab of the rear sheet of the first bag of the bag pack being lightly adhesively adhered to the neck of the forward sheet of the next ensuing bag of the pack at a point adjacent to, but below, the slits in the tab necks; said method comprising:

(a) providing a roll of plastic tubing to provide when flattened pairs of coinciding plastic sheets;

(b) at predetermined distances perforating the flattened tube transversely;

(c) heat sealing the tube along a line adjacent and parallel to each side of the transverse perforation to form a tube closed at each end;

(d) severing the flattened tube along each perforation to create a series of tubular bags sealed at both ends;

(e) die cutting out from a preselected end of each bag a central portion from the edge of said end downwardly, to leave a pair of handles sealed at their upper ends, and upwardly from the lower edge of said cut-out central portion a tab for each sheet of the bag, said tabs comprising an upwardly extending expanded section connected by a narrow neck to the lower edge of its sheet, said expanded portion being slotted, and said neck having a transverse slit between, but not extending to, the edges of said neck;

(f) applying a hot adhesive to a preselected spot adjacently below the transverse slit in the neck of the outside of one sheet;

(g) immediately placing the bag, to the tab of which the adhesive has been applied, in registering and pressing contact with a second similarly formed bag so that the neck of the sheet forming in the second bag which is placed in contact with the neck of the sheet of the first bag, is adhered to, and (h) repeating the steps of (a) through (h) to produce a registering pack of preselected number of bags.

* * * * *